US008437679B2

(12) United States Patent
Wilde et al.

(10) Patent No.: US 8,437,679 B2
(45) Date of Patent: May 7, 2013

(54) SYSTEM AND METHOD FOR RECYCLING CLEANING LIQUID IN A PRINTER

(75) Inventors: Oren Wilde, Rishon Le Zion (IL); Yavin Atzmon, Nes Ziona (IL); Peter Nedelin, Ashdod (IL); Moshe Peles, Lapid (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 935 days.

(21) Appl. No.: 12/261,313

(22) Filed: Oct. 30, 2008

(65) Prior Publication Data

US 2009/0175665 A1 Jul. 9, 2009

Related U.S. Application Data

(60) Provisional application No. 61/020,084, filed on Jan. 9, 2008.

(51) Int. Cl.
*G03G 21/00* (2006.01)

(52) U.S. Cl.
USPC ..... 399/358

(58) Field of Classification Search ..... 399/348, 399/358; 347/86; 134/104.1, 104.4
See application file for complete search history.

(56) References Cited

U.S. PATENT DOCUMENTS

| | | | | |
|---|---|---|---|---|
| 4,964,987 | A | 10/1990 | Johnson | |
| 5,997,189 | A * | 12/1999 | Nakamura et al. | 396/565 |
| 6,158,447 | A | 12/2000 | Kamikawa et al. | |
| 6,343,610 | B1 | 2/2002 | Berger et al. | |
| 7,010,259 | B2 | 3/2006 | Gila et al. | |
| 2005/0082238 | A1 * | 4/2005 | Larson | 210/799 |
| 2005/0201785 | A1 * | 9/2005 | Gila et al. | 399/348 |

FOREIGN PATENT DOCUMENTS

| | | |
|---|---|---|
| WO | WO9904907 | 2/1999 |

* cited by examiner

*Primary Examiner* — Walter L Lindsay, Jr.
*Assistant Examiner* — Barnabas Fekete

(57) ABSTRACT

A system for recycling a liquid in a printer comprises a first reservoir configured for collecting possibly polluted liquid to be recycled from the printer, a filtration system configured for purifying the liquid received from the first reservoir, and a second reservoir configured for collecting the liquid from the filtration system, wherein overflow from the second reservoir is directed to the first reservoir.

22 Claims, 3 Drawing Sheets

SYSTEM AND METHOD FOR RECYCLING CLEANING LIQUID IN A PRINTER

CROSS-REFERENCE TO RELATED PATENT APPLICATIONS

This application claims the benefit of U.S. provisional patent application Ser. No. 61/020,084, filed on Jan. 9, 2008, entitled "SYSTEM AND METHOD FOR RECYCLING CLEANING LIQUID IN A PRINTER".

FIELD OF THE INVENTION

The present invention relates to electro-photography printing devices and more particularly to recycling liquids in printers.

BACKGROUND OF THE INVENTION

The method of electro-photographic printing is well known in the art. In this method, a photoconductive surface, typically on a drum, is charged to a uniform potential. The charged photoreceptor and/or photoconductive surface are exposed to a light image from, for example, a writing head laser that discharges specific areas on the photoconductive surface. This records an electrostatic latent image on the photoconductive surface. After the photoconductive image is recorded, the latent image is developed with liquid toner. The developed image is transferred to an intermediate transfer member (ITM) such as a blanket and subsequently transferred to a substrate, such as paper. The ITM is typically heated to improve transferability of the developed image.

Between prints, a cleaning station applies a cleaning liquid, e.g. imaging oil, on a developer surface, e.g. the photoconductive surface to pickup any residual material, e.g. toner and/or surface material left on the surface. The cleaning liquid is also used to cool the developer surface. The cleaning liquid is subsequently removed together with any residual material collected and returned to a reservoir where the liquid is stored. The cleaning liquid is recirculated using a filtration system that pumps liquid from the reservoir, through one or more filters and a heat exchanger, and returns the filtered and cooled cleaning liquid back to the reservoir. The heat exchanger serves to maintain the cleaning liquid in the reservoir at a working temperature suitable for cleaning the developed surfaces. Typically, cleaning liquid is supplied to the cleaning station through an intersection between the cleaning station pump outlet and the filters so that the temperature and quality of the cleaning liquid supplied to the cleaning station is the same as that of the cleaning liquid in the reservoir.

Over time and with use, the filters used to remove residual material from the cleaning liquid may get plugged causing incremental flow reduction through the filtration system as well as to the cleaning station. As the flow through the filtration system decreases, the quality of the cleaning liquid in the reservoir is diminished and the temperature of the reservoir increases. Typically, an increase in the reservoir temperature above a pre-defined threshold is used as an indication to replace the filters.

U.S. Pat. No. 7,010,259 entitled "Apparatus and Method for Cleaning an Image Transfer Device" assigned to Hewlett-Packard Development Company, LP., the contents of which are hereby incorporated by reference in its entirety, describes a printer with two cleaning stations each associated with a tank for supplying cleaning liquid to one cleaning station and for receiving cleaning liquid with residual material from that cleaning station. Cleaning oil for both tanks is replenished by adding new liquid to one of the tanks and providing liquid communication between the tanks. As the volume of the tank that is not directly replenished with new liquid decreases it is replenished with liquid from the tank that is directly replenished with clean liquid. Although, the liquid is replenished, both tanks include a combination of clean and polluted liquid.

U.S. Pat. No. 6,343,610 entitled Method and Apparatus for Recycling Coolant for a Cutting Machine, assigned to Masco Corporation of Indiana, the contents of which are hereby incorporated by reference in its entirety, describes a skimming operation and a method of separating degreasing solution from the coolant mixture for recycling in the degreasing system. The skimmer includes a tank with a main chamber, an intermediate chamber and a collector. The used aqueous dispensing solution is collected by overflow into the collector from which it is delivered to an associated dirty coolant tank for use as feedstock in the coolant solution.

International Patent Publication No. WO09904907, entitled Ultrasonic Atomizing Device with Liquid Circulating Line, assigned to Green Clouds LTD, the contents of which are hereby incorporated by reference in its entirely, describes an ultrasonic device for atomizing liquids including at least one atomization unit containing a liquid to be atomized, a means for circulating the liquids to be atomized through a reservoir across each transducer and back to the reservoir. Overflow liquid from the unit carries both the floating type impurities and those settling type impurities which have been carried this far in the flowing liquid's current. This overflow liquid completes the circulation by returning to the reservoir. Thus impurities tend to concentrate in the reservoir rather than in the unit or on the transducer.

U.S. Pat. No. 4,964,987 entitled Cross Flow Filter Apparatus, filed Jun. 10, 1988, the contents of which are hereby incorporated by reference in its entirety, describes a cross flow filter apparatus and method that uses an open tank having a first liquid retaining section, a second filter retaining section and a third solids collecting section in fluid communication with each other. The floating contaminant removal means can comprise an overflow trough configuration disposed adjacent the top edge of the tank having a fluid outlet for removal of the floating contaminants which overflow into the solids collection section.

SUMMARY OF THE INVENTION

An aspect of some embodiments of the present invention is the provision of a system and method for cleaning and recycling polluted cleaning liquid in a printer. According to some embodiments of the present invention, the system includes a first reservoir for collecting polluted cleaning liquid from a cleaning station of a printer and a second reservoir for collecting recycled cleaning liquid. For example, liquid collected in the first reservoir is recycled through a filtration system and deposited into the second reservoir. The recycled cleaning liquid is pumped from the second reservoir to the cleaning station.

According to some embodiments of the present invention, the first and second reservoirs are in liquid communication so that overflow of recycled, e.g. filtered cleaning liquid from the second reservoir is directed back to the first reservoir containing the polluted cleaning liquid. According to some embodiments of the present invention the recycled liquid in the second reservoir is filtered to remove debris collected from the developer surfaces. According to some embodiments, the provision of overflow out of the second reservoir facilitates maintaining a constant height of liquid in the second reservoir associated with the second pump and thereby a constant inlet pressure to the cleaning station.

According to some embodiments of the present invention, the recycled liquid in the second reservoir is cooled to a defined working temperature. According to some embodiments of the present invention, overflow of the cooled liquid to the first reservoir facilitates reducing the temperature of the liquid in the first reservoir to maintain the temperature below a defined safety level temperature.

An aspect of some embodiments of the present invention is the provision of a system and method for supplying recycled cleaning liquid to a cleaning station at a substantially constant flow rate.

According to some embodiments of the present invention, the system includes a first pump for pumping cleaning liquid received from a cleaning station through a filtration system and a second pump for pumping the cleaning liquid recycled through the filtration system back to the cleaning station at a constant flow rate. According to some embodiments of the present invention, the flow rate to the cleaning station is not substantially affected by changes in the filter resistance during the lifespan of the filters. According to some embodiments of the present invention, the constant flow rate to the cleaning station is facilitated by providing a constant inlet pressure to the second pump.

According to some embodiments of the present invention, cleaning liquid, e.g. polluted cleaning liquid collected from the cleaning station, is collected in a first reservoir. According to some embodiments of the present invention, the first pump pumps liquids from the first reservoir through a filtration system into the second reservoir and the second pump provides the recycled liquids stored in the first reservoir to the cleaning station for use by the cleaning station. In some exemplary embodiments, the constant inlet pressure to the second pump is facilitated by providing a constant and/or near constant height of liquid in the second reservoir. According to some embodiments, overflow of recycled cleaning liquid above the constant height is directed toward the first reservoir. According to some embodiments of the present invention, the filtration system includes a heat exchanger to cool the cleaning liquid.

The present inventors have found that providing a steady flow of filtered cleaning liquid to the cleaning station reduces occurrences of scratches on the photoconductive surface and thereby increases the lifespan of the photoconductive surface. In addition providing a steady flow of cleaning fluid to the cleaning station improves the performance of the printer and the quality of the prints.

An aspect of some embodiments of the present invention is the provision of a system and method for cooling recycled cleaning liquid to defined working temperature level. According to some embodiments of the present invention, the system includes a first reservoir for collecting cleaning liquid, e.g. polluted cleaning liquid, from a cleaning station of a printer and a second reservoir for collecting recycled cleaning liquid to be supplied to the cleaning station. According to some embodiments of the present invention, only the liquid stored in the second reservoir is cooled to the defined working temperature. According to some exemplary embodiments, a heat exchanger is used to cool the recycled cleaning liquid prior to reaching the second reservoir. In some exemplary embodiments a temperature controlling unit, e.g. a thermostat positioned in the second reservoir controls the cooling rate of the heat exchanger and maintains the temperature in the second reservoir at the defined working temperature. According to some embodiments of the present invention, overflow of cooled cleaning liquid from the second reservoir is directed to the first reservoir. In some exemplary embodiments, the overflow facilitates cooling the cleaning liquid in the first reservoir to a temperature below a defined safety temperature level. Typically, the defined safety temperature is substantially higher than the defined working temperature. In some exemplary embodiments, a second thermostat in electrical communication with the heat exchanger is included in the first reservoir to insure that the temperature in the first reservoir does not rise above a safety temperature.

According to some exemplary embodiments, separation of the filtered liquid from the non-filtered liquid facilitates cooling only the filtered liquid to be reused by the cleaning station to the defined working temperature level. Limiting the volume of the liquid to that requires cooling to the working temperature level serves to ease the working load on the heat exchanger and potentially increases its lifespan. Furthermore, flow reduction through the filtration system due to plugging of the filter does not substantially affect the cooling rate of the cleaning liquid in the second reservoir and therefore does not require significant changes in heat exchanger outlet temperature to compensate for the reduction of flow as may be required by the prior art systems.

An aspect of some embodiments of the present invention provides a system for recycling a liquid in a printer comprising a first reservoir configured for collecting possibly polluted liquid to be recycled from the printer, a filtration system configured for purifying the liquid received from the first reservoir, and a second reservoir configured for collecting the liquid from the filtration system, wherein overflow from the second reservoir is directed to the first reservoir.

Optionally, the filtration system comprises a temperature controlling unit configured to control the temperature of the liquid in the second reservoir.

Optionally, the system comprises a pump fluidly connected to the second reservoir and to a unit of the printer, wherein the pump is configured to supply the liquid from the second reservoir to the unit at a substantially constant flow rate.

Optionally, comprises a pump fluidly connected to the second reservoir and a unit of the printer, wherein the pump is configured to supply liquid from the second reservoir to the unit without an intervening filter.

Optionally, the first and second reservoirs are separated by a partition wall over which liquid from the second reservoir overflows to the first reservoir.

Optionally, the height of the partition wall is configured to provide a substantially constant height of liquid in the second reservoir.

Optionally, the filtration system is configured for removing residual material collected from a photoconductive surface of the printer.

An aspect of some embodiments of the present invention provides a method for recycling a liquid in a printer, the method comprising, collecting liquid from a cleaning station into a first reservoir, filtering at least part of the liquid collected to obtain filtered liquid, and depositing the filtered liquid in a second reservoir, wherein overflow from the second reservoir is directed to the first reservoir.

Optionally, the method comprises controlling the temperature in the second reservoir, by cooling the liquid therein or flowing thereto.

Optionally, the method comprises pumping carrier liquid from the second reservoir to the cleaning station with a pump wherein the carrier liquid is supplied to the pump a substantially constant inlet pressure.

Optionally, the method comprises controlling the height of the liquid in the second reservoir to a constant value.

An aspect of some embodiments of the present invention provides a system for controlling flow rate of recycled liquid to a cleaning station of a printer comprising a first reservoir configured for collecting liquid from a cleaning station, a filtration system configured for recycling liquid received from the first reservoir, a second reservoir configured for collecting liquid from the filtration system, wherein overflow from the second reservoir is directed to the first reservoir, and a pump configured to supply carrier liquid from the second reservoir to the cleaning station at a substantially constant flow rate.

Optionally, the system comprises a pump configured to pump liquid from the first reservoir through the filtration system wherein the flow rate through the pump configured to pump liquid from the first reservoir through the filtration system is higher than the flow rate through the pump fluidly connected to the second reservoir.

Optionally, the first and second reservoirs are separated by a partition wall.

Optionally, the height of the partition wall is configured to provide a substantially constant height of liquid in the second reservoir.

Optionally, the inlet pressure to the pump is substantially constant.

An aspect of some embodiments of the present invention provides a method for controlling flow rate of recycled liquid to a cleaning station of a printer, the method comprising collecting liquid from a cleaning station into a first reservoir, transferring liquid from the first reservoir through a filtration system into a second reservoir, wherein overflow from the second reservoir is directed to the first reservoir, and supplying liquid from the second reservoir to the cleaning station at a controlled flow rate.

Optionally, the method comprises receiving recycled liquid from the filtration system at a variable flow rate and supplying liquid from the second reservoir to the cleaning station at a constant flow rate.

Optionally, the method comprises maintaining a constant height of liquid in the second reservoir.

Optionally, liquid collected in the second reservoir above the constant height of liquid is directed to the first reservoir.

Optionally, transferring liquid from the first reservoir through the filtration system is performed at a flow rate that is higher than the flow rate for supplying liquid from the second reservoir to the cleaning station.

An aspect of some embodiments of the present invention provides a system for cooling a recycled liquid in a printer comprising a first reservoir configured for collecting liquid from a cleaning station of the printer, a cooling system configured for recycling liquid received from the first reservoir, and a second reservoir configured for collecting liquid that was cooled, wherein overflow from the second reservoir is directed to the first reservoir.

Optionally, the system comprises a temperature controlling unit for controlling the temperature in the second reservoir.

Optionally, the overflow from the second reservoir to the first reservoir facilitates cooling of the liquid in the first reservoir.

Optionally, the system comprises a pump to pump liquid into the cleaning station at a defined working temperature.

Optionally, the system comprises a temperature controlling unit for controlling the temperature in the first reservoir, wherein the temperature in the first reservoir is maintained above the temperature of the second reservoir.

An aspect of some embodiments of the present invention provides a method for cooling a recycled liquid in a printer, the method comprising collecting liquid from a cleaning station into a first reservoir, cooling at least part of the liquid to a defined working temperature, and collecting the liquid cooled to the defined working temperature into a second reservoir, wherein overflow from the second reservoir is directed to the first reservoir.

Optionally, the method comprises controlling the temperature in the second reservoir.

Optionally, the method comprises pumping liquid into the cleaning station from the second reservoir.

An aspect of some embodiments of the present invention provides a printer comprising a cleaning station configured for recycling imaging oil comprising a first reservoir configured for collecting the imaging from the cleaning station, a filtration system configured for purifying the imaging oil received from the first reservoir for recycling, and a second reservoir configured for collecting the imaging oil recycled from the filtration system, wherein overflow from the second reservoir is directed to the first reservoir.

Optionally, the filtration system comprises a temperature controlling unit configured to control the temperature of the imaging oil in the second reservoir.

Optionally, the printer comprises a pump fluidly connected to the second reservoir and the cleaning station, wherein the pump is configured to supply imaging oil to the cleaning station at a substantially constant flow rate.

Optionally, the printer comprises a pump fluidly connected to the second reservoir and the cleaning station, wherein the pump is configured to supply imaging oil to the cleaning station without an intervening filter.

Optionally, the first and second reservoirs are separated by a partition wall over which imaging oil from the second reservoir overflows to the first reservoir.

Optionally, the height of the partition wall is configured to provide a substantially constant height of imaging oil in the second reservoir.

Optionally, the filtration system is configured for removing residual material collected from a photoconductive surface of the printer.

BRIEF DESCRIPTION OF THE DRAWINGS

The subject matter regarded is particularly and distinctly claimed in the concluding portion of the specification. Non-limiting examples of embodiments of the present invention are described below with reference to figures attached hereto, which are listed following this paragraph. In the figures, identical structures, elements or parts that appear in more than one figure are generally labeled with a same symbol in all the figures in which they appear. Dimensions of components and features shown in the figures are chosen for convenience and clarity of presentation and are not necessarily shown to scale. For example, the dimensions of some of the elements may be exaggerated relative to other elements for clarity.

Figure 1:
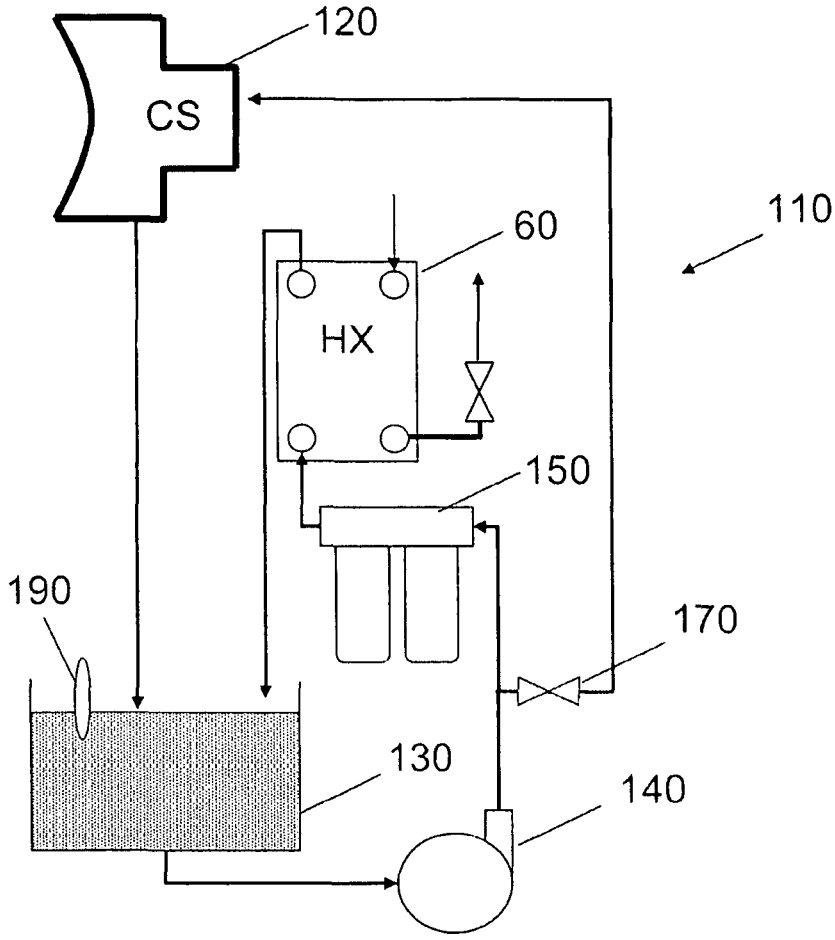
Figure 1 (PRIOR ART)
FIG. 1 is an exemplary schematic illustration of a prior art system for cleaning and recirculating cleaning liquid to a cleaning station of a printer.

it will be appreciated that for simplicity and clarity of illustration, elements shown in the figures have not necessarily been drawn to scale. Further, where considered appropriate, reference numerals may be repeated among the figures to indicate corresponding or analogous elements.

DETAILED DESCRIPTION OF EXEMPLARY EMBODIMENTS

In the following description, exemplary, non-limiting embodiments of the invention incorporating various aspects of the present invention are described. For purposes of explanation, specific configurations and details are set forth in order to provide a thorough understanding of the embodiments. However, it will also be apparent to one skilled in the art that the present invention may be practiced without the specific details presented herein. Furthermore, well-known features may be omitted or simplified in order not to obscure the present invention. Features shown in one embodiment may be combined with features shown in other embodiments. Such features are not repeated for clarity of presentation. Furthermore, some unessential features are described in some embodiments.

Reference is now made to FIG. 1 showing an exemplary schematic illustration of a prior art system for cleaning and recirculating cleaning liquid to a cleaning station of a printer. The recirculating system 110 typically collects used and/or polluted cleaning liquid received from the cleaning station 120 into a reservoir 130. Typically the temperature of the polluted cleaning liquid collected from the cleaning station is at a higher temperature than the temperature of the cleaning liquid originally supplied to the cleaning station. The cleaning liquid is recirculated by pumping cleaning liquid with a pump 140 through a filtration system including one or more filters 150 and a heat exchanger 160 to cool the cleaning liquid. Typically, the heat exchanger uses cold water in order to cool the imaging oil. According to one embodiment, the heat exchanger includes refrigeration. The filtered and cooled cleaning liquid is returned to reservoir 130. Typically a valve 170 positioned on a flow line between the pump outlet and filters 150, supplies the recirculated cleaning liquid to the cleaning station. The recirculated cleaning liquid directed to the cleaning station includes both filtered and non-filtered cleaning liquid. Over time and with use as filters 150 get plugged, the pressure on the flow line increases and the flow rate to the cleaning station rises. The present inventors have found that this rise in flow rate can cause cleaning station to leak. Typically, in some prior art systems for which the present invention is to be used, the desired flow rate to the cleaning station is approximately 3 liters/minute although the flow rate through the flow line between the pump and the filters may vary between approximately 8 to 16 liters/minute depending on the resistance of flow through the filters.

Typically a thermostat 190 in electrical communication with heat exchanger 160 is stationed in reservoir 130 to monitor the temperature of the cleaning liquid and to provide feedback to the heat exchanger so as to maintain the temperature of the liquid in the reservoir at a defined working temperature. In response to a drift in temperature in reservoir 130, the heat exchanger may adjust its cooling rate to compensate. As the filters get plugged and the flow through the heat exchanger slows down, the heat exchanger may become less effective in cooling all the liquid in the reservoir to the defined working temperature. In addition the workload on the heat exchanger may increase and may overload the heat exchanger, potentially shortening its lifespan. If the heat exchanger is not able to maintain the temperature at the predefined level, e.g. 14° C., the filters are replaced. The defined working temperature of the cleaning liquid supplied to the cleaning station is approximately 14° C., e.g. between 12° C. to 14° C. Typically, the temperature of the cleaning liquid collected from the cleaning station after use may range between 18° C. to 22° C. The increase in temperature is typically due to warming of the photoconductor due to its contact with and/or proximity to the heated intermediate transfer member (ITM). The cooled cleaning liquid coating the photoconductor facilitates counteracting the heating effect of the ITM. Typically the heat exchanger used in such a system is designed for a flow rate of up to approximately 8 liters/minute. Typically, the flow rate through the heat exchanger at the point when the filters are replaced is approximately 16 liters/minute.

Figure 2:
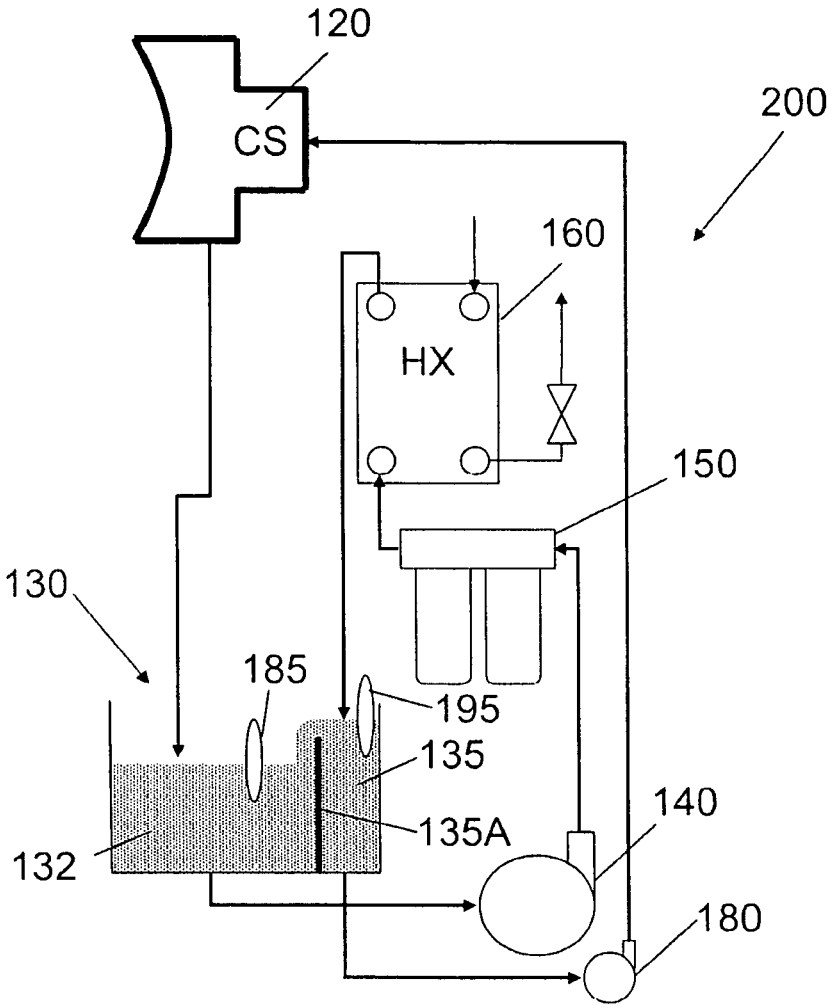
FIG. 2 is an exemplary schematic illustration of a system for cleaning and recycling cleaning liquid to a cleaning station of a printer according to some embodiments of the present invention.

Reference is now made to FIG. 2 showing a schematic illustration of a system for recycling cleaning liquid to a cleaning station of a printer according to some embodiments of the present invention. According to some embodiments of the present invention, recycling includes at least purification of the cleaning liquid. According to some embodiments of the present invention, recycling system 200 includes a first pump 140 for pumping liquid through a filtration and/or purification unit 150 and a second pump 180 for supplying cleaning liquid to the cleaning station 120. According to some embodiments of the present invention, reservoir 130 is partitioned with a partition wall 135A into a first reservoir 132 to collect cleaning liquid from cleaning station 120 and a second reservoir 135 where cleaning liquid is collected after undergoing a recycling process. Typically, the liquid is recycled by pumping the liquid with a pump 140 from reservoir 132 through one or more filters 150 and through heat exchanger 160. Liquid from the outlet of the heat exchanger is deposited into reservoir 135. A second pump 180 sucks liquid from reservoir 135 to cleaning station 120. According to some embodiments of the present invention, the flow rate through pump 180 is practically independent from the flow rate of pump 140 and/or the flow rate through filters 150. Therefore the flow rate through pump 180 may be set and maintained at a desired pre-defined rate that is appropriate for the cleaning station regardless of the resistance through the filters. Typically pump 180 is a DC pump that may be calibrated to facilitate a desired flow rate.

According to some embodiments of the present invention, partition 135A between reservoir 132 and reservoir 135 is set at a defined position and height to maintain a defined height of liquid in reservoir 135. According to some embodiments, filtered liquid reaching above the height of partition 135A overflows back into reservoir 132. According to some embodiments of the present invention, the height of the liquid in reservoir 135 is selected to facilitate a desired inlet pressure to pump 180. Maintaining a defined inlet pressure to pump 180 facilitates maintaining a constant flow rate, e.g. predefined flow rate, through pump 180 and to cleaning station 120. According to some embodiments of the present invention, the position of the partition wall and the volume of reservoir 135 are selected so as to sustain at least a pre-defined height of liquid in reservoir 135. Typically, the volume of reservoir 135 is selected taking into account the expected flow rate into and out of the reservoir. Typically, the position of the partition wall is defined so that the volume of reservoir 135 is smaller than that of reservoir 132. In one exemplary embodiment reservoir 135 may have a capacity of about ½ to ⅓ of reservoir 132. For example, ⅓ of the volume of liquid may be contained in reservoir 135 while approximately ⅔ of the liquid may be contained in reservoir 132.

According to other embodiments of the present invention, reservoir 132 and 135 may be displaced from each other, e.g.

may not share a common partition wall, and overflow from reservoir 135 may be directed to reservoir 132 through a dedicated channel.

According to some embodiments of the present invention, controlling the height of liquid in reservoir 135 provides a controlled inlet pressure to pump 180, e.g. a constant inlet pressure. Supplying a constant inlet pressure to pump 180 may increase the lifespan of the pump that may typically be sensitive to different inlet pressures. According to one exemplary embodiment, a pressure regulator may be added to the flow line to regulate the inlet pressure to pump 180.

Typically the flow rate through pump 140 is higher than the flow rate though pump 180. For example, the flow rate through pump 140 may range between 4-10 liters/min while the flow rate through pump 180 may range between 2-4 liters/minute, e.g. 3 liters/minute. This assures that the liquid level in reservoir 135 remains constant and that there is always overflow in reservoir 132.

According to some embodiments of the present invention, a thermostat 195 in electrical communication with heal exchanger 160 is placed in reservoir 135 to monitor the temperature of the recycled cleaning liquid in reservoir 135 and to adjust the cooling rate of the heat exchanger in response to a drift in temperature. Typically, the heat exchanger is used to cool the temperature of the recycled cleaning liquid to a defined working temperature, e.g. 14° C. According to some embodiments of the present invention, only the recycled cleaning liquid in reservoir 135 is actively maintained at the defined working temperature while the bulk of the liquid found in reservoir 132 is allowed to drift to a temperature above the working temperature. Reducing the volume of the liquid that is required to be cooled to the working temperature reduces the overall working load on the heat exchanger. As such the life span of the filters as well as the heat exchanger may be improved. According to some embodiments of the present invention, the overflow from reservoir 135 to reservoir 132 facilitates cooling the temperature of the liquid of reservoir 132. Typically, the temperature of reservoir 132 is not cooled to the working temperature. However, the overflow from reservoir 135 to reservoir 132 may facilitate maintaining the temperature of the liquid in reservoir 132 below a safety temperature, e.g. 50° C.

According to some embodiments of the present invention, a second thermostat 185 may be positioned in reservoir 132 to monitor the temperature of the liquid in reservoir 132 so that it is maintained below a desired safety temperature. According to some embodiments of the present invention, thermostat 185 may be in electrical communication with heat exchanger 160. In one exemplary embodiment, in reaction to temperature reading in reservoir 132 above a specified temperature, e.g. safety temperature, the heat exchanger 160 may increase the cooling rate of the recycled cleaning liquid to promote overflow to reservoir 132. According to one embodiment of the present invention, thermostat 185 may be in electrical communication with the pump 140 to increase flow rate through pump 140 and in reaction increase overflow to reservoir 132.

According to some embodiments of the present invention, a temperature above the safety temperature may cause shutting down of the system. According to some embodiments of the present invention, overflow is not part of the recycling process and/or the filtration process. However, the overflow is instrumental in maintaining a steady inlet pressure to pump 180 that supplies recycled cleaning liquid to the cleaning station and is also instrumental in cooling the temperature of the reservoir 132. Although some of the recycled liquid is "wasted" by being poured back to the reservoir 132, the system is in general more efficient than the prior art system since only a small portion of the liquid is cooled as compared to prior art systems where all the liquid may be cooled (e.g. recycled as well as polluted liquid). According to some embodiments of the present invention, the recycling system 200 may improve the lifespan of the heat exchanger as well as the filters. According to some embodiments of the present invention, increasing the life span of elements in the printer may reduce the number of service visits required by the printer and therefore increase the number of prints before service is required. According to some embodiments of the present invention, providing a system that facilitates supplying a constant flow rate of clean and/or recycled cleaning liquid as is described herein facilitates improving the performance of the cleaning station, and the quality of the prints. For example, the cleaning station is able to clean the developer surfaces better leading to a better print job.

Figure 3:
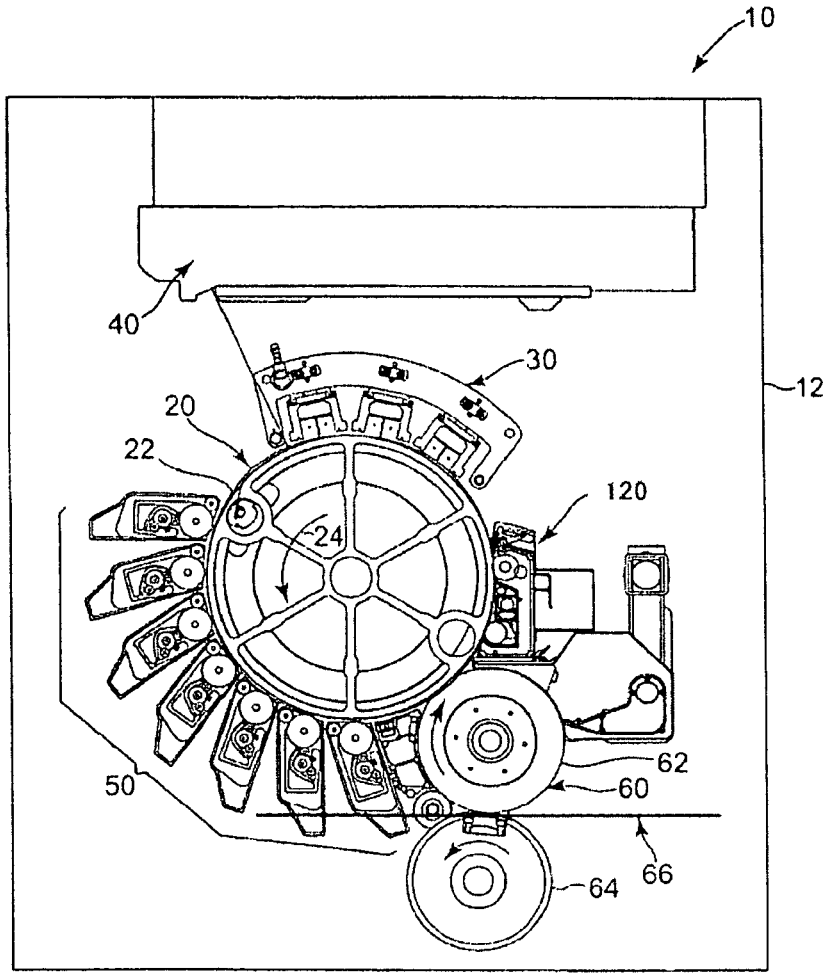
FIG. 3 is a schematic illustration of a liquid electrophotographic printer utilizing a cleaning station according to some embodiments of the present invention.

Reference is now made to FIG. 3 showing a schematic illustration of a liquid electrophotographic (LEP) printer utilizing a cleaning station according to some embodiments of the present invention. According to some embodiments of the present invention, an LEP printer 10 includes a printer housing 12 having installed therein a photoconductor drum 20 having a photoconductor surface 22. Photoconductor drum 20 is rotatably mounted within printer housing 12 and rotates in the direction of arrow 24. Several additional printer components surround photoconductor drum 20, including a charging device 30, an exposure device 40, a development device 50, an image transfer device 60, and a cleaning station 120.

Charging device 30 charges photoconductor surface 22 oh drum 20 to a predetermined electric potential (typically ±500 to 1000 V). Exposure device 40 forms an electrostatic latent image on the photoconductor surface 22 by scanning a light beam (such as a laser) according to the image to be printed onto the photoconductor surface 22. The electrostatic latent image is due to a difference in the surface potential between the exposed and unexposed portion of photoconductor surface 22. Exposure device 40 exposes images on photoconductor surface 22 corresponding to various colors, for example, yellow (Y), magenta (M), cyan (C) and black (K), respectively. Exposure device 40 may have a single scanning device for exposing different image colors consecutively, or multiple scanning devices for exposing different image colors concurrently. Development device 50 supplies development liquid, which may be a mixture of solid toner and imaging oil, to photoconductor surface 22 to adhere the toner to the portion of photoconductor surface 22 where the electrostatic latent image is formed, thereby forming a visible toner image on photoconductor surface 22. Development device 50 may supply various colors of toner corresponding to the color images exposed by exposure device 40. Image transfer device 60 includes an intermediate transfer roller 62 in contact with photoconductor surface 22, and a fixation or impression roller 64 in contact with transfer roller 62. As transfer roller 62 is brought into contact with photoconductor surface 22, the image is transferred from photoconductor surface 22 to transfer roller 62. A printing sheet 66 is fed between transfer roller 62 and impression roller 64 to transfer the image from transfer roller 62 to printing sheet 66. Impression roller 64 fuses the toner image to printing sheet 66 by the application of heat and/or pressure. Cleaning station 120 cleans the photoconductor surface 22 of residual material using a cleaning fluid before photoconductor surface 22 is used for printing subsequent images. Typically, the cleaning fluid is a carried liquid used in the toner. According to some embodiments of the present invention, the cleaning fluid is imaging oil as used by development device 50. According to some embodiments of the present invention, imaging oil polluted after cleaning photoconductor surface 22 is recycled, e.g. cleaned for subsequent use by the cleaning station 120. According to some embodiments of the present invention, polluted cleaning liquid and/or carrier liquid may be collected from the ITM and/or from other units in the printer and may also be recycled.

Although the system and methods describe may have been described specifically for recycling cleaning liquid supplied to a cleaning station of a printer, similar system and methods may be applied for recycling carried liquids of liquid toners for other units in the printer. It should be further understood that the individual features described hereinabove can be combined in all possible combinations and sub-combinations to produce exemplary embodiments of the invention. Furthermore, not all elements described for each embodiment are essential. In many cases such elements are described so as to describe a best more for carrying out the invention or to form a logical bridge between the essential elements. The examples given above are exemplary in nature and are not intended to limit the scope of the invention which is defined solely by the following claims.

The terms "include", "comprise" and "have" and their conjugates as used herein mean "including but not necessarily limited to".

The invention claimed is:

1. A system comprising:

a first reservoir configured for collecting possibly polluted liquid to be recycled from a printer;

a filtration system configured for purifying the liquid received from the first reservoir; and a second reservoir configured for collecting the liquid from the filtration system wherein the first reservoir and the second reservoir are separated by only one partition wall over which liquid from the second reservoir is to overflows into the first reservoir, the liquid to be transferred from the first reservoir through the filtration system at a flow rate that is higher than a flow rate for liquid to be supplied from the second reservoir to a cleaning station.

2. The system according to claim 1 wherein the filtration system comprises a temperature controlling unit configured to control the temperature of the liquid in the second reservoir.

3. The system according to claim 1 comprising a pump fluidly connected to the second reservoir and to a unit of the printer, wherein the pump is configured to supply the liquid from the second reservoir to the unit at a substantially constant flow rate.

4. The system according to claim 1 comprising a pump fluidly connected to the second reservoir and a unit of the printer, wherein the pump is configured to supply liquid from the second reservoir to the unit without an intervening filter.

5. A method, comprising:

collecting liquid from a cleaning station into a first reservoir;

transferring the liquid from the first reservoir through a filtration system into a second reservoir, the first reservoir and the second reservoir separated by only one partition wall over which liquid from the second reservoir overflows into the first reservoir;

supplying liquid from the second reservoir to a cleaning station at a controlled flow rate; and transferring liquid from the first reservoir through the filtration system at a flow rate that is higher than a flow rate for supplying liquid from the second reservoir to the cleaning station.

6. The method according to claim 5 comprising receiving recycled liquid from the filtration system at a variable flow rate and supplying liquid from the second reservoir to the cleaning station at a constant flow rate.

7. The method according to claim 5 comprising maintaining a constant height of liquid in the second reservoir.

8. The method according to claim 7 wherein liquid collected in the second reservoir above the constant height of liquid is directed to the first reservoir.

9. A system comprising:

a first reservoir configured for collecting liquid from a cleaning station of a printer;

a cooling system configured for recycling liquid received from the first reservoir; and a second reservoir configured for collecting liquid that was cooled, wherein the first reservoir and the second reservoir are separated by only one partition wall over which liquid from the second reservoir overflows into the first reservoir, wherein liquid is transferred from the first reservoir through the cooling system at a flow rate that is higher than a flow rate for supplying liquid from the second reservoir to the cleaning station.

10. The system according to claim 9 comprising a temperature controlling unit for controlling the temperature in the second reservoir.

11. The system according to claim 9 wherein the overflow from the second reservoir to the first reservoir facilitates cooling of the liquid in the first reservoir.

12. The system according to claim 9 comprising a pump to pump liquid into the cleaning station at a defined working temperature.

13. The system according to claim 9 comprising a temperature controlling unit for controlling the temperature in the first reservoir, wherein the temperature in the first reservoir is maintained above the temperature of the second reservoir.

14. A method, comprising:

collecting liquid from a cleaning station into a first reservoir;

cooling at least part of the liquid to a defined working temperature; and collecting the liquid cooled to the defined working temperature into a second reservoir, wherein the first reservoir and the second reservoir are separated by only one partition wall over which liquid from the second reservoir overflows into the first reservoir, wherein liquid is transferred from the first reservoir through a cooling system at a flow rate that is higher than a flow rate for supplying liquid from the second reservoir to the cleaning station.

15. The method according to claim 14 comprising controlling the temperature in the second reservoir.

16. The method according to claim 14 comprising pumping the liquid into the cleaning station from the second reservoir.

17. An apparatus, comprising:

a cleaning station configured for recycling imaging oil comprising:

a first reservoir configured for collecting the imaging oil from the cleaning station;

a filtration system configured for purifying the imaging oil received from the first reservoir for recycling; and a second reservoir configured for collecting the imaging oil recycled from the nitration system, wherein the first reservoir and the second reservoir are separated by only one partition wall over which imaging oil from the second reservoir overflows into the first reservoir, wherein liquid is transferred from the first reservoir through the filtration system at a flow rate that is higher than a flow rate for supplying liquid from the second reservoir to the cleaning station.

18. The apparatus according to claim 17 wherein the filtration system comprises a temperature controlling unit configured to control the temperature of the imaging oil in the second reservoir.

19. The apparatus according to claim 17 comprising a pump fluidly connected to the second reservoir and the cleaning station, wherein the pump is configured to supply imaging oil to the cleaning station at a substantially constant flow rate.

20. The apparatus according to claim 17 comprising a pump fluidly connected to the second reservoir and the cleaning station, wherein the pump is configured to supply imaging oil to the cleaning station without an intervening filter.

21. The apparatus according to claim 17 wherein the height of the partition wall is configured to provide a substantially constant height of imaging oil in the second reservoir.

22. The apparatus according to claim 17 wherein the filtration system is configured for removing residual material collected from a photoconductive surface of the printer.

* * * * *

UNITED STATES PATENT AND TRADEMARK OFFICE

CERTIFICATE OF CORRECTION

PATENT NO. : 8,437,679 B2
APPLICATION NO. : 12/261313
DATED : May 7, 2013
INVENTOR(S) : Oren Wilde et al.

It is certified that error appears in the above-identified patent and that said Letters Patent is hereby corrected as shown below:

In the Claims:

In column 11, lines 37-38, in Claim 1, delete "overflows" and insert -- overflow --, therefor.

Signed and Sealed this
Third Day of September, 2013

Teresa Stanek Rea
*Acting Director of the United States Patent and Trademark Office*